US010783782B1

(12) United States Patent
Wang et al.

(10) Patent No.: US 10,783,782 B1
(45) Date of Patent: Sep. 22, 2020

(54) VEHICLE MANAGEMENT

(71) Applicant: International Business Machines Corporation, Armonk, NY (US)

(72) Inventors: Zhi Hu Wang, Beijing (CN); Shiwan Zhao, Beijing (CN); Li Zhang, Beijing (CN); Jun Zhu, Shanghai (CN)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 0 days.

(21) Appl. No.: 16/296,525

(22) Filed: Mar. 8, 2019

(51) Int. Cl.
*G08G 1/0967* (2006.01)
*G08G 1/01* (2006.01)

(52) U.S. Cl.
CPC ..... *G08G 1/096791* (2013.01); *G08G 1/0112* (2013.01); *G08G 1/0129* (2013.01)

(58) Field of Classification Search
CPC ..... G08G 1/096791
USPC ..... 340/905
See application file for complete search history.

(56) References Cited

U.S. PATENT DOCUMENTS 8,718,910 B2 * 5/2014 Gueziec ..... G08G 1/0112 701/119
8,768,606 B2 * 7/2014 Ren ..... G08G 1/00 701/117
8,972,175 B2 * 3/2015 Annapureddy .... G01C 21/3453 701/423
9,601,009 B2 * 3/2017 Scofield ..... G08G 1/0141
2003/0006888 A1 * 1/2003 Burchette, Jr. ..... B60R 1/12 340/425.5

OTHER PUBLICATIONS

"Waze," Wikipedia, 7 pages. Retrieved on Feb. 12, 2019. https://en.wikipedia.org/wiki/Waze.

* cited by examiner

*Primary Examiner* — Qutbuddin Ghulamali
(74) *Attorney, Agent, or Firm* — Amin, Turocy & Watson, LLP

(57) ABSTRACT

A computer-implemented method, a device and a computer program product for managing a vehicle are proposed. The computer-implemented method comprises: a determining, by a device operatively coupled to one or more processing units, a potential road section associated with a current road section on which a first vehicle is moving, the potential road section being a road section to which the first vehicle potentially moves from the current road section; obtaining, by the device, a road condition of the potential road section, the road condition being generated at least based on monitoring records of a second vehicle moving on the potential road section; and in response to the road condition indicating that the potential road section is unsuitable for moving on, transmitting, by the device, an alert about the potential road section to the first vehicle.

20 Claims, 10 Drawing Sheets

VEHICLE MANAGEMENT

BACKGROUND

Embodiments of the present invention relate to processing information, and more specifically, to a computer-implemented method, device and computer program product facilitating vehicle management.

SUMMARY

Knowledge of a condition of a road section is essential for drivers who wish to travel to that road section. Such knowledge can facilitate the drivers in selecting traveling routes, avoiding congested road sections, saving time traveling, improving safety in traveling, and so on. However, generally, the condition of a road section, also referred to as the road condition, provided by current web map services, are inaccurate and coarse-grained. As such, it is difficult for the drivers to better understand the actual road conditions, and to make better decisions. Thus, providing an accurate and fine-grained web map service becomes a challenge.

According to one embodiment of the present invention, there is provided a computer-implemented method of managing a vehicle. The computer-implemented method comprises: determining, by a device operatively coupled to one or more processing units, a potential road section associated with a current road section on which a first vehicle is moving, the potential road section being a road section to which the first vehicle potentially moves from the current road section; obtaining, by the device, a road condition of the potential road section, the road condition being generated at least based on monitoring records of a second vehicle moving on the potential road section; and in response to the road condition indicating that the potential road section is unsuitable for moving on, transmitting, by the device, an alert about the potential road section to the first vehicle.

In another embodiment, a device, comprises: a memory that stores computer executable components; and a processing unit operably coupled to the memory, and that executes the computer executable components stored in the memory. The computer executable components comprise at least one computer-executable component that: determines a potential road section associated with a current road section on which a first vehicle is moving, the potential road section being a road section to which the first vehicle potentially moves from the current road section; obtains a road condition of the potential road section, the road condition being generated at least based on monitoring records of a second vehicle moving on the potential road section; and in response to the road condition indicating that the potential road section is unsuitable for moving on, transmits an alert about the potential road section to the first vehicle.

In another embodiment, a computer program product facilitating displaying messages based on categories related to message importance is provided. The computer program product comprises a computer readable storage medium having program instructions embodied therewith, the program instructions executable by one or more processors to cause the one or more processors to: determine, by the one or more processors, a potential road section associated with a current road section on which a first vehicle is moving, the potential road section being a road section to which the first vehicle potentially moves from the current road section; obtain, by the one or more processors, a road condition of the potential road section, the road condition being generated at least based on monitoring records of a second vehicle moving on the potential road section; and in response to the road condition indicating that the potential road section is unsuitable for moving on, transmit, by the one or more processors, an alert about the potential road section to the first vehicle.

BRIEF DESCRIPTION OF THE DRAWINGS

Through the more detailed description of some embodiments of the invention in the accompanying drawings, the above and other objects, features and advantages of the invention will become more apparent, wherein the same reference generally refers to the same components in the embodiments of the invention.

Throughout the drawings, same or similar reference numerals represent the same or similar element.

DETAILED DESCRIPTION

Figure 1:
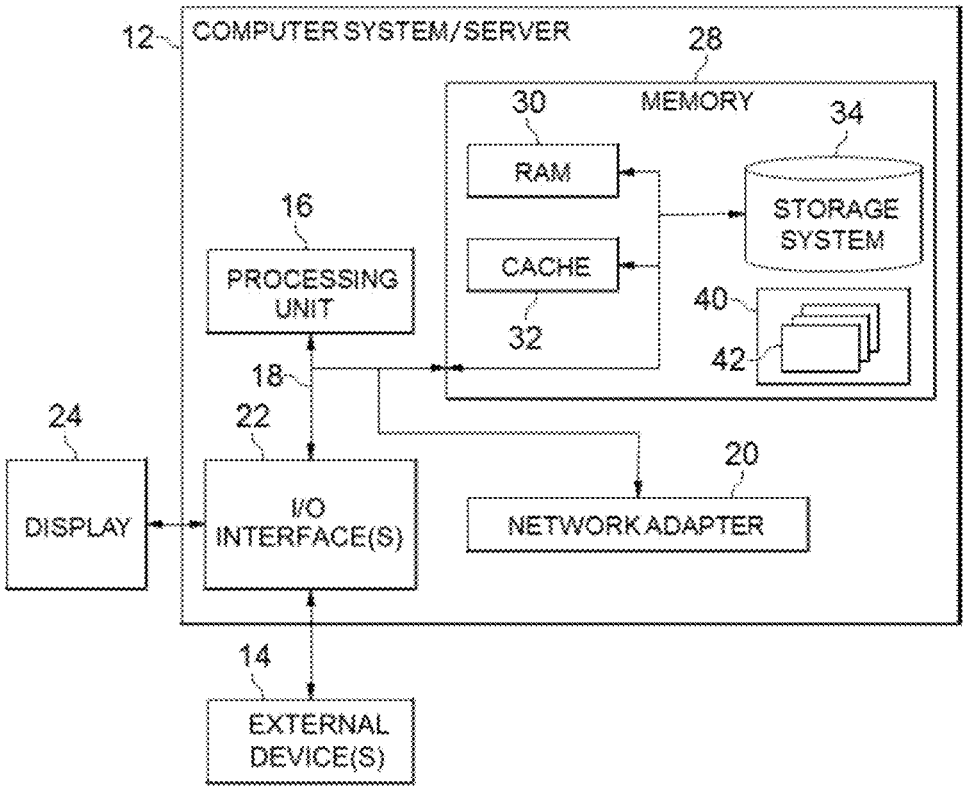
FIG. 1 depicts a cloud computing node according to an embodiment of the present invention.

Some embodiments will be described in more detail with reference to the accompanying drawings, in which the embodiments of the invention have been illustrated. However, the present disclosure can be implemented in various manners, and thus should not be construed to be limited to the embodiments disclosed herein.

As used herein, the term "includes" and its variants are to be read as open ended terms that mean "includes, but is not limited to." The term "based on" is to be read as "based at least in part on." The term "one embodiment" and "an embodiment" are to be read as "at least one embodiment." The term "another embodiment" is to be read as "at least one other embodiment." Other definitions, explicit and implicit, may be included below.

It is to be understood that although this disclosure includes a detailed description on cloud computing, implementation of the teachings recited herein are not limited to a cloud computing environment. Rather, embodiments of the present invention are capable of being implemented in conjunction with any other type of computing environment now known or later developed.

Cloud computing is a model of service delivery for enabling convenient, on-demand network access to a shared pool of configurable computing resources (e.g. networks, network bandwidth, servers, processing, memory, storage, applications, virtual machines, and services) that can be rapidly provisioned and released with minimal management effort or interaction with a provider of the service. This cloud model may include at least five characteristics, at least three service models, and at least four deployment models.

Characteristics are as follows:

On-demand self-service: a cloud consumer can unilaterally provision computing capabilities, such as server time and network storage, as needed automatically without requiring human interaction with the service's provider.

Broad section network access: capabilities are available over a network and accessed through standard mechanisms that promote use by heterogeneous thin or thick client platforms (e.g., mobile phones, laptops, and PDAs).

Resource pooling: the provider's computing resources are pooled to serve multiple consumers using a multi-tenant model, with different physical and virtual resources dynamically assigned and reassigned according to demand There is a sense of location independence in that the consumer generally has no control or knowledge over the exact location of the provided resources but may be able to specify location at a higher level of abstraction (e.g., country, state, or datacenter).

Rapid elasticity: capabilities can be rapidly and elastically provisioned, in some cases automatically, to quickly scale out and rapidly released to quickly scale in. To the consumer, the capabilities available for provisioning often appear to be unlimited and can be purchased in any quantity at any time.

Measured service: cloud systems automatically control and optimize resource use by leveraging a metering capability at some level of abstraction appropriate to the type of service (e.g., storage, processing, bandwidth, and active user accounts). Resource usage can be monitored, controlled, and reported providing transparency for both the provider and consumer of the utilized service.

Service Models are as follows:

Software as a Service (SaaS): the capability provided to the consumer is to use the provider's applications running on a cloud infrastructure. The applications are accessible from various client devices through a thin client interface such as a web browser (e.g., web-based e-mail). The consumer does not manage or control the underlying cloud infrastructure including network, servers, operating systems, storage, or even individual application capabilities, with the possible exception of limited user-specific application configuration settings.

Platform as a Service (PaaS): the capability provided to the consumer is to deploy onto the cloud infrastructure consumer-created or acquired applications created using programming languages and tools supported by the provider. The consumer does not manage or control the underlying cloud infrastructure including networks, servers, operating systems, or storage, but has control over the deployed applications and possibly application hosting environment configurations.

Infrastructure as a Service (IaaS): the capability provided to the consumer is to provision processing, storage, networks, and other fundamental computing resources where the consumer is able to deploy and run arbitrary software, which can include operating systems and applications. The consumer does not manage or control the underlying cloud infrastructure but has control over operating systems, storage, deployed applications, and possibly limited control of select networking components (e.g., host firewalls).

Deployment Models are as follows:

Private cloud: the cloud infrastructure is operated solely for an organization. It may be managed by the organization or a third party and may exist on-premises or off-premises.

Community cloud: the cloud infrastructure is shared by several organizations and supports a specific community that has shared concerns (e.g., mission, security requirements, policy, and compliance considerations). It may be managed by the organizations or a third party and may exist on-premises or off-premises.

Public cloud: the cloud infrastructure is made available to the general public or a large industry group and is owned by an organization selling cloud services.

Hybrid cloud: the cloud infrastructure is a composition of two or more clouds (private, community, or public) that remain unique entities but are bound together by standardized or proprietary technology that enables data and application portability (e.g., cloud bursting for load-balancing between clouds).

A cloud computing environment is service oriented with a focus on statelessness, low coupling, modularity, and semantic interoperability. At the heart of cloud computing is an infrastructure that includes a network of interconnected nodes.

Referring now to FIG. 1, a schematic of an example of a cloud computing node is shown. Cloud computing node 10 is only one example of a suitable cloud computing node and is not intended to suggest any limitation as to the scope of use or functionality of embodiments of the invention described herein. Regardless, cloud computing node 10 is capable of being implemented and/or performing any of the functionality set forth hereinabove.

In cloud computing node 10 there is a computer system/server 12 or a portable electronic device such as a communication device, which is operational with numerous other general purpose or special purpose computing system environments or configurations. Examples of well-known computing systems, environments, and/or configurations that may be suitable for use with computer system/server 12 include, but are not limited to, personal computer systems, server computer systems, thin clients, thick clients, handheld or laptop devices, multiprocessor systems, microprocessor-based systems, set top boxes, programmable consumer electronics, network PCs, minicomputer systems, mainframe computer systems, and distributed cloud computing environments that include any of the above systems or devices, and the like.

Computer system/server 12 may be described in the general context of computer system-executable instructions, such as program modules, being executed by a computer system. Generally, program modules may include routines, programs, objects, components, logic, data structures, and so on that perform particular tasks or implement particular abstract data types. Computer system/server 12 may be practiced in distributed cloud computing environments where tasks are performed by remote processing devices that are linked through a communications network. In a distributed cloud computing environment, program modules may be located in both local and remote computer system storage media including memory storage devices.

As shown in FIG. 1, computer system/server 12 in cloud computing node 10 is shown in the form of a general-purpose computing device. The components of computer system/server 12 may include, but are not limited to, one or more processors or processing units 16, a system memory 28, and a bus 18 that couples various system components including system memory 28 to processor 16.

Bus 18 represents one or more of any of several types of bus structures, including a memory bus or memory controller, a peripheral bus, an accelerated graphics port, and a processor or local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnect (PCI) bus.

Computer system/server 12 typically includes a variety of computer system readable media. Such media may be any available media that is accessible by computer system/server 12, and it includes both volatile and non-volatile media, removable and non-removable media.

System memory 28 can include computer system readable media in the form of volatile memory, such as random access memory (RAM) 30 and/or cache memory 32. Computer system/server 12 may further include other removable/non-removable, volatile/non-volatile computer system storage media. By way of example only, storage system 34 can be provided for reading from and writing to a non-removable, non-volatile magnetic media (not shown and typically called a "hard drive"). Although not shown, a magnetic disk drive for reading from and writing to a removable, non-volatile magnetic disk (e.g., a "floppy disk"), and an optical disk drive for reading from or writing to a removable, non-volatile optical disk such as a CD-ROM, DVD-ROM or other optical media can be provided. In such instances, each can be connected to bus 18 by one or more data media interfaces. As will be further depicted and described below, memory 28 may include at least one program product having a set (e.g., at least one) of program modules that are configured to carry out the functions of embodiments of the invention.

Program/utility 40, having a set (at least one) of program modules 42, may be stored in memory 28 by way of example, and not limitation, as well as an operating system, one or more application programs, other program modules, and program data. Each of the operating system, one or more application programs, other program modules, and program data or some combination thereof, may include an implementation of a networking environment. Program modules 42 generally carry out the functions and/or methodologies of embodiments of the invention as described herein.

Computer system/server 12 may also communicate with one or more external devices 14 such as a keyboard, a pointing device, a display 24, etc.; one or more devices that enable a user to interact with computer system/server 12; and/or any devices (e.g., network card, modem, etc.) that enable computer system/server 12 to communicate with one or more other computing devices. Such communication can occur via Input/Output (I/O) interfaces 22. Still yet, computer system/server 12 can communicate with one or more networks such as a local area network (LAN), a general wide area network (WAN), and/or a public network (e.g., the Internet) via network adapter 20. As depicted, network adapter 20 communicates with the other components of computer system/server 12 via bus 18. It should be understood that although not shown, other hardware and/or software components could be used in conjunction with computer system/server 12. Examples, include, but are not limited to: microcode, device drivers, redundant processing units, external disk drive arrays, RAID systems, tape drives, and data archival storage systems, etc.

Figure 2:
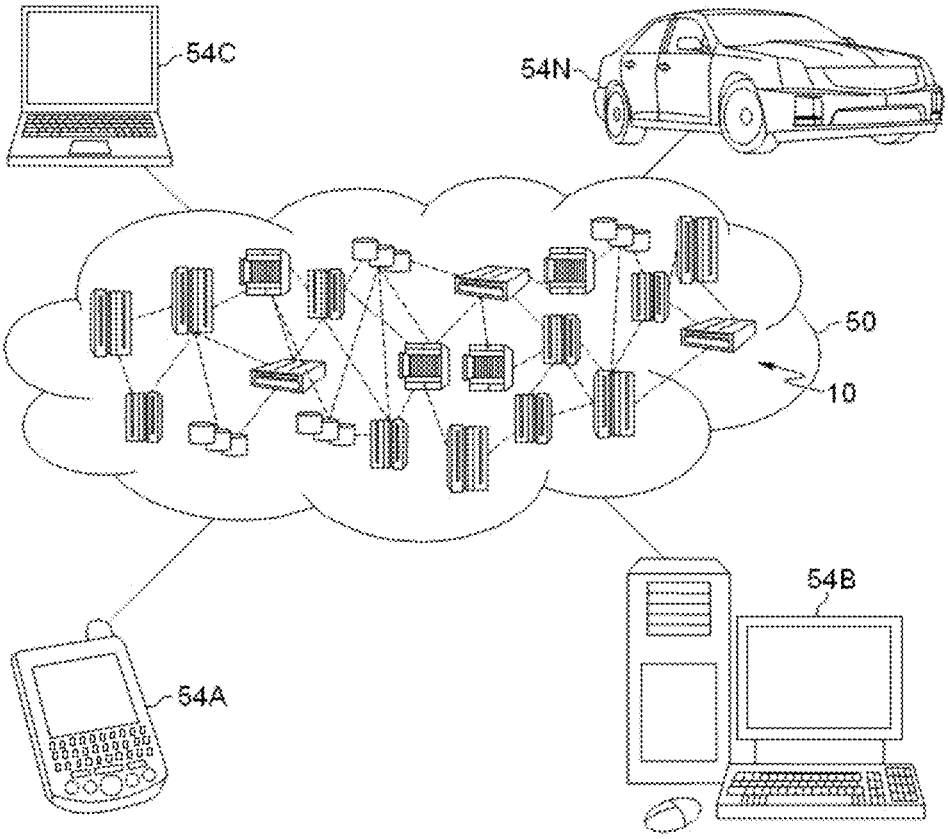
FIG. 2 depicts a cloud computing environment according to an embodiment of the present invention.

Referring now to FIG. 2, illustrative cloud computing environment 50 is depicted. As shown, cloud computing environment 50 includes one or more cloud computing nodes 10 with which local computing devices used by cloud consumers, such as, for example, personal digital assistant (PDA) or cellular telephone 54A, desktop computer 54B, laptop computer 54C, and/or automobile computer system 54N may communicate. Nodes 10 may communicate with one another. They may be grouped (not shown) physically or virtually, in one or more networks, such as Private, Community, Public, or Hybrid clouds as described hereinabove, or a combination thereof. This allows cloud computing environment 50 to offer infrastructure, platforms and/or software as services for which a cloud consumer does not need to maintain resources on a local computing device. It is understood that the types of computing devices 54A-N shown in FIG. 2 are intended to be illustrative only and that computing nodes 10 and cloud computing environment 50 can communicate with any type of computerized device over any type of network and/or network addressable connection (e.g., using a web browser).

Figure 3:
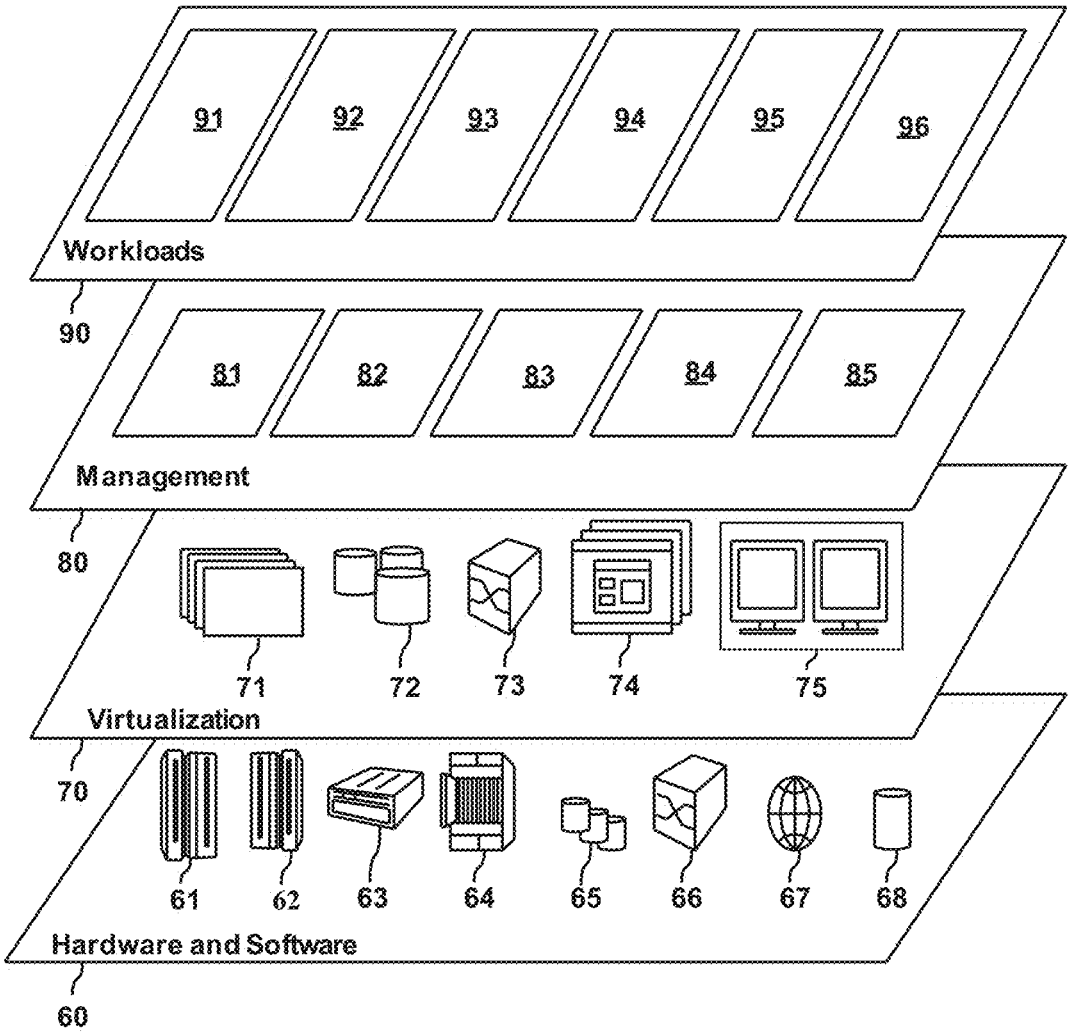
FIG. 3 depicts abstraction model layers according to an embodiment of the present invention.

Referring now to FIG. 3, a set of functional abstraction layers provided by cloud computing environment 50 (FIG. 2) is shown. It should be understood in advance that the components, layers, and functions shown in FIG. 3 are intended to be illustrative only and embodiments of the invention are not limited thereto. As depicted, the following layers and corresponding functions are provided:

Hardware and software layer 60 includes hardware and software components. Examples of hardware components include: mainframes 61; RISC (Reduced Instruction Set Computer) architecture based servers 62; servers 63; blade servers 64; storage devices 65; and networks and networking components 66. In some embodiments, software components include network application server software 67 and database software 68.

Virtualization layer 70 provides an abstraction layer from which the following examples of virtual entities may be provided: virtual servers 71; virtual storage 72; virtual networks 73, including virtual private networks; virtual applications and operating systems 74; and virtual clients 75.

In one example, management layer 80 may provide the functions described below. Resource provisioning 81 provides dynamic procurement of computing resources and other resources that are utilized to perform tasks within the cloud computing environment. Metering and Pricing 82 provide cost tracking as resources are utilized within the cloud computing environment, and billing or invoicing for consumption of these resources. In one example, these resources may include application software licenses. Security provides identity verification for cloud consumers and tasks, as well as protection for data and other resources. User portal 83 provides access to the cloud computing environment for consumers and system administrators. Service level management 84 provides cloud computing resource allocation and management such that required service levels are met. Service Level Agreement (SLA) planning and fulfillment 85 provide pre-arrangement for, and procurement of, cloud computing resources for which a future requirement is anticipated in accordance with an SLA.

Workloads layer 90 provides examples of functionality for which the cloud computing environment may be utilized. Examples of workloads and functions which may be provided from this layer include: mapping and navigation 91; software development and lifecycle management 92; virtual classroom education delivery 93; data analytics processing 94; transaction processing 95; and vehicle managing 96.

It should be noted that the processing of managing a vehicle or achieved by a device for managing a vehicle according to embodiments of this disclosure could be implemented by computer system/server 12 of FIG. 1.

As described above, the road conditions provided by the current web map services can be inaccurate and coarse-grained. For example, the current web map services generally use a limited number of colors to indicate limited types of road conditions. For example, "green" indicates a good road condition, and "red" indicates a poor road condition such as severe congestion. However, the drivers cannot know details of the actual road conditions by using the current web map services, and thus may not make optimal routing decisions.

For example, when an accident occurs on a road section, a driver may only be able to know from a web map service that the road section has a low level of congestion at an initial stage. However, the accident can be so severe that the accident eventually causes severe congestion at a later time. Unfortunately, the driver can be misled by the web map service at the initial stage and drive to that road section and encounter severe congestion.

In order to at least partially solve one or more of the above problems and other potential problems, example embodiments of the invention propose a solution for managing a vehicle. In the solution, a potential road section associated with a current road section on which a first vehicle is moving can be determined. The potential road section can be a road section to which the first vehicle potentially moves from the current road section. A road condition of the potential road section is obtained. The road condition can be generated at least based on monitoring records of a second vehicle moving on the potential road section. In response to the road condition indicating that the potential road section is unsuitable for moving on, an alert about the potential road section can be transmitted to the first vehicle. It is to be appreciated that an alert, in a non-limiting example, can be at least one of an audio, visual, textual, haptic, electronic notification, or any other suitable alert mechanism that is transmitted and/or presented to a recipient of the alert on a device associated with or in proximity to the recipient.

As such, the road condition of the potential road section can be determined accurately, and the driver can be informed of the actual condition of the potential road section in advance. In this case, it is possible for the driver to make a reasonable decision in selecting an optimal route based on the received alert, thus improving the traffic conditions and reducing the time cost.

Figure 4:
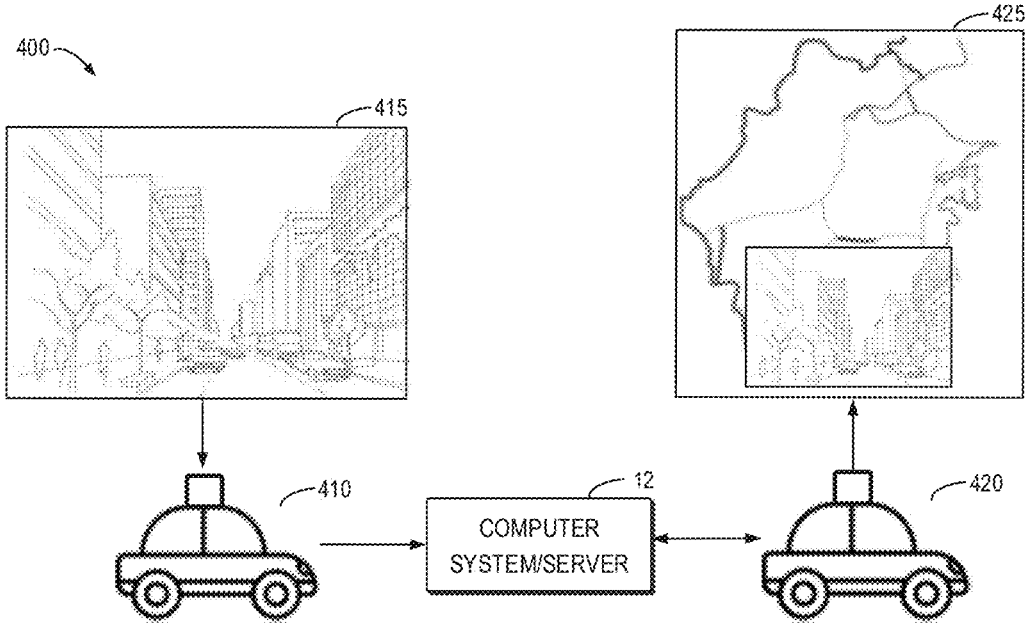
FIG. 4 depicts a schematic diagram of an example vehicle management environment according to an embodiment of the present invention.

Reference is now made to FIG. 4, which depicts a schematic diagram of an example vehicle management environment 400 according to an embodiment of the present invention. As shown in FIG. 4, a vehicle 410 participates in the vehicle management environment 400. The vehicle 410 can be a car, a bus, a bicycle, a balance car or any appropriate vehicle that can facilitate the movement of the user.

The vehicle 410 can collect information, more specifically monitoring records, associated with the vehicle 410 when moving. The monitoring records can include, for example, a video 415 captured in association with movement of the vehicle 410, a position of the vehicle 410 when capturing the video 415, time when the vehicle 410 captures the video 415, and the like. Vehicle 410 can employ an instrument (not shown) installed on vehicle 410 to automatically collect information as vehicle 410 is moving. Non-limiting examples of instruments installed on vehicle 410 can include a camera, a microphone, a speedometer, a crash sensor, a smoke detector, a temperature sensor, an air flow sensor, a radar system, a lidar system, a global positioning system sensor, an airbag sensor, a chemical sensor, or any suitable sensor that can be installed on a vehicle.

The vehicle 410 can provide the collected monitoring records to the computer system/server 12. In some embodiments, the collected monitoring records can be stored locally in the computer system/server 12, or remotely in a remote storage accessible by the computer system/server 12. As such, the computer system/server 12 can use the stored monitoring records to assist another vehicle participating in the vehicle management environment 400 (for example, the vehicle 420).

The computer system/server 12 can determine a road section on which the vehicle 410 is moving, and further determine a road condition of the road section. The road section is a certain section of a road network of a map. For example, the computer system/server 12 can determine an identification of the road section, a direction of the road section, a congestion level of the road section, an offset of an accident (if any) occurred on the road section, and the like.

In this case, when a vehicle 420 participating in the vehicle management environment 400 potentially moves to the road section, the computer system/server 12 can transmit an alert 425 about the road section to the vehicle 420. Alternatively, the computer system/server 12 can first determine that the vehicle 420 potentially moves to a road section, and then request the monitoring records from the vehicle 410 moving on the road section to determine a road condition of the road section.

To determine the potential road section of the vehicle 420, the vehicle 420 can for example collect a plurality of positions of the vehicle 420 during moving, and provide them to the computer system/server 12. The computer system/server 12 can determine, based on the plurality of positions and a map comprising at least the plurality of positions, a current road section on which the vehicle 420 is moving.

Then, the computer system/server 12 can determine a potential road section associated with the current road section. The potential road section is a road section to which the vehicle 420 potentially moves from the current road section. The computer system/server 12 can obtain the condition of the potential road section that has been already determined based on monitoring records of a vehicle previously moving on the potential road section. For example, assume that the vehicle 410 previously moves on the potential road section, the computer system/server 12 can obtain the road condition of the potential road section determined based on the monitoring records of the vehicle 420.

If the obtained road condition indicates that the potential road section is unsuitable for moving on, the computer system/server 12 can transmit an alert 425 about the road section to the vehicle 420. For example, if the road condition indicates that severe congestion and/or an accident occurred on the road section, the computer system/server 12 can transmit an alert 425 including the video 415 captured by the vehicle 410 regarding the congestion and/or the accident to the vehicle 420. Additionally or alternatively, the alert 425 can also include the identification of the road section, the direction of the road section, the congestion level of the road section, the offset of the accident, and the like.

In another example, computer system/server 12 can analyze monitoring records from vehicle 410 and/or other vehicles (not shown) associated with the potential road section to predict a future level of congestion at an estimated time at which vehicle 420 and/or other vehicles will arrive at the potential road section. Computer system/server 12 can generate an alert for vehicle 420 and/or other vehicles if the predicted future level of congestion exceeds a threshold level of congestion.

In another example, computer system/server 12 can command another vehicle that is on the potential road section at a time after a previous vehicle 410 was on the potential road section at an earlier time to obtain current monitoring records on the potential road section to determine if there has been a change in the road condition from when the previous vehicle 410 was on the potential road section.

In a further example, vehicle 420 can present an interface (e.g. a user interface or application programming interface (API)) in conjunction with alert to a driver of vehicle 420 that enables the driver to request computer system/server 12 to locate another vehicle that is currently on the potential road section associated with the alert to obtain current monitoring records on the potential road section to determine if there has been a change in the road condition from when the previous vehicle 410 was on the potential road section. It is to be appreciated that a driver can be a human driver, a robotic driver, or self-driving computer.

In the above text, the vehicle 410 is described as collecting the monitoring records and the vehicle 420 is described as receiving the alert. However, it should be understood that, the solution is not limited thereto. For example, the vehicle 410 can receive the alert and the vehicle 420 can collect the monitoring records. In addition, although just one vehicle 410 collecting the monitoring records and one vehicle 420 receiving the alert are described, the number of vehicles are not limited thereto, and thus can form a crowd-sourced solution.

As such, the computer system/server 12 can alert the driver of the vehicle 420 the actual condition of the potential road section, and facilitate the driver to make a better decision on which route to drive, thus saving the time of the driver and improving the user experience of the web map service.

Figure 5:
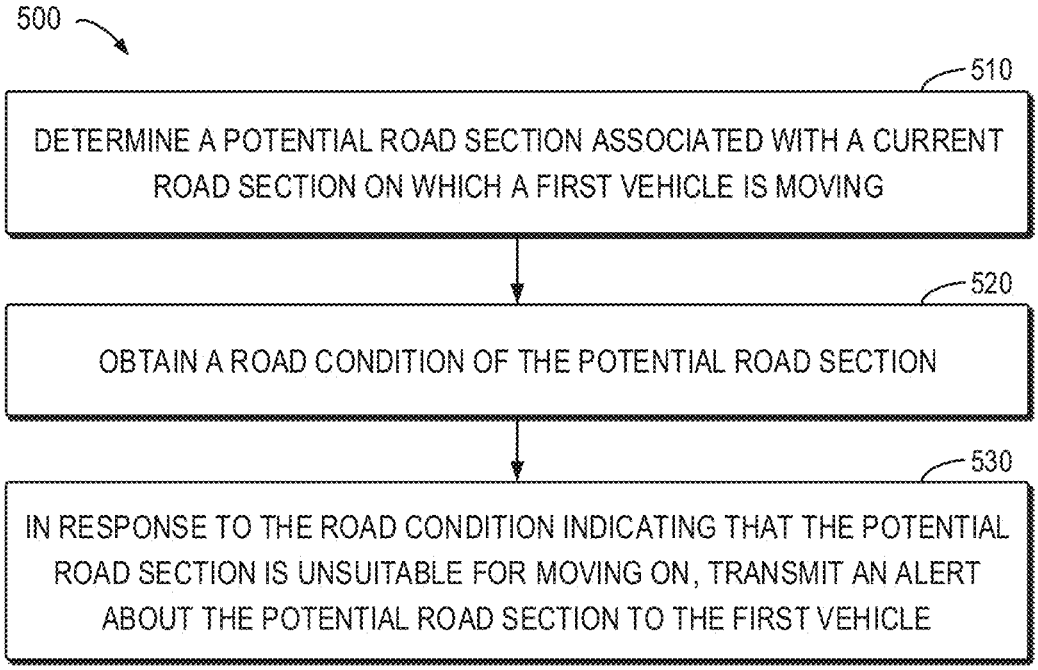
FIG. 5 depicts a flow chart of an example computer-implemented method of managing a vehicle according to an embodiment of the present invention.

FIG. 5 depicts a flow chart of an example computer-implemented method 500 of managing a vehicle according to an embodiment of the present invention. The computer-implemented method 500 can be at least in part implemented by the computer system/server 12, or other suitable systems.

At 510, the computer system/server 12 can determine a potential road section associated with a current road section on which a first vehicle (for example, the vehicle 420) is moving. The potential road section is a road section to which the first vehicle potentially moves from the current road section.

In some embodiments, the computer system/server 12 can first determine the current road section. For example, the first vehicle can send a plurality of positions of the first vehicle during moving. Specifically, the position can be latitude and longitude of the first vehicle in the Global Position System (GPS). As shown in the schematic diagram 600 of FIG. 6, the first vehicle can send the positions 610-640.

Then, the computer system/server 12 can determine the current road section based on the plurality of positions and a map comprising at least the plurality of positions. For example, the computer system/server 12 can determine the current road section by map mapping. As a specific example, the computer system/server 12 can map the plurality of positions into one or more road sections, and select a road section to be the current road section according to the shortest path algorithm. As shown in the schematic diagram 700 of FIG. 7, the computer system/server 12 can determine the current road section 710 based on the received positions 610-640 by map mapping. In this case, the road section on which the vehicle is currently moving can be determined accurately.

It should be understood that, in the above text, determination of the current road section of the first vehicle (for example, the vehicle 420) which is to be notified of the road condition of the potential road section is described. However, the road section of the second vehicle (for example, the vehicle 410) which has collected the monitoring records of the road section can also be determined in the same approach.

Figure 7:
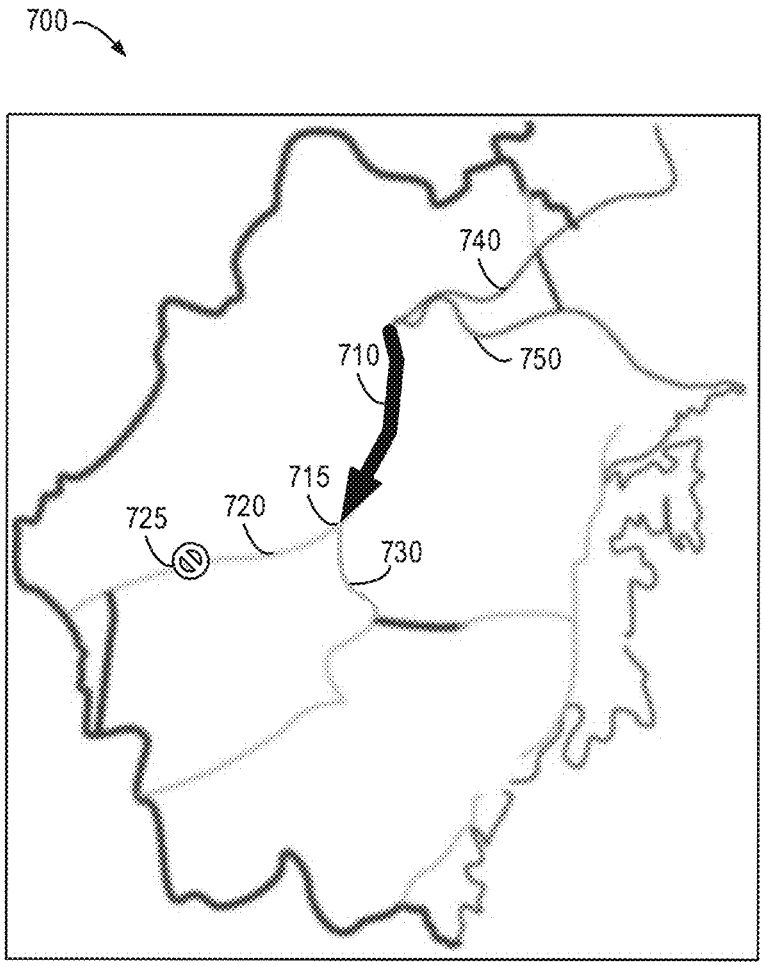
FIG. 7 depicts a schematic diagram of a road section on which a vehicle is moving according to an embodiment of the present invention.

Then, the computer system/server 12 can determine the potential road section associated with the current road section. In some embodiments, the computer system/server 12 can determine a moving direction of the first vehicle on the current road section. For example, the first vehicle can send a series of position information to the computer system/server 12. The position information can include latitude and longitude of the first vehicle in the Global Position System (GPS). Optionally, the position information can include the time when the first vehicle is at a respective GPS position. Then, the computer system/server 12 can determine the moving direction of the first vehicle based on the received position information. For example, as shown in FIG. 7, the moving direction of the first vehicle determined by the computer system/server 12 can be indicated by an arrow.

Figure 6:
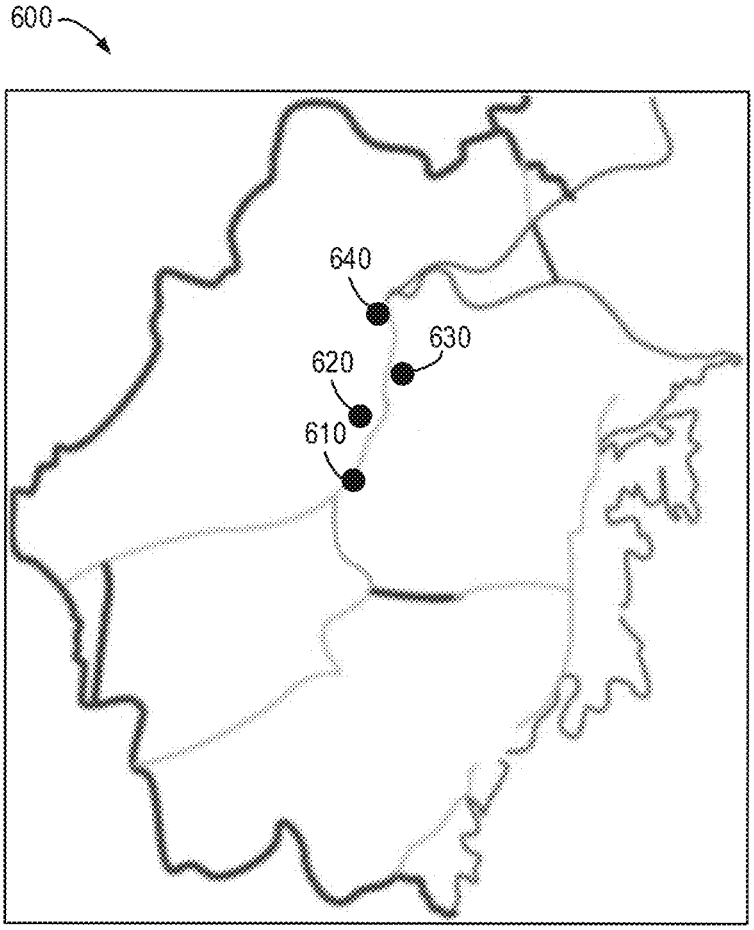
FIG. 6 depicts a schematic diagram of a plurality of positions of the vehicle during moving according to an embodiment of the present invention.

Additionally, the computer system/server 12 can determine a set of candidate road sections connected to the current road section. For example, as shown in FIG. 7, the set of candidate road sections are the road sections 720-750. The computer system/server 12 can select a candidate road section in the set of candidate road sections to be the potential road section. A direction of the selected candidate road section matches the moving direction. In some embodiments, the difference between the direction of selected candidate road section and the moving direction can be below a predetermined threshold. For example, as shown in FIG. 6, since the direction of the road section 720 matches the moving direction, the road section 720 can be selected to be the potential road section.

Alternatively, to determine to the potential road section, the computer system/server 12 can obtain a set of historical movement patterns of the first vehicle. The set of historical movement patterns is generated based on historical movement behaviors of the first vehicle. For example, the driver of the first vehicle can previously travel from his or her home to office, from home to a hospital, from office to school and the like along certain routes. Such historical movement behaviors can thus form a set of historical movement patterns.

The computer system/server 12 can select, from the set of historical movement patterns, a historical movement pattern matching the current road section. For example, the current road section can be a part of the route from the home to the office. In this case, the computer system/server 12 can select the historical movement pattern regarding the route from the home to the office. Then, the computer system/server 12 can determine the potential road section based on the selected historical movement pattern and the current road section. For example, the potential road section can be the road section that is to travel from the current road section along the selected route.

Yet another way to determine to the potential road section is obtaining, by the computer system/server 12, navigation information of the first vehicle. The navigation information indicates a destination of the first vehicle. The computer system/server 12 can determine the potential road section based on the navigation information and the current road section. For example, the computer system/server 12 can obtain the navigation information indicating that the first vehicle is to travel to the office, and determine that the potential road section is the road section that is to travel from the current road section along the route to the office.

Through the above example approaches for determining the potential road section, the potential road section can be properly predicted based on the current road section and the behavior of the driver.

After determining the potential road section, the computer system/server 12 can obtain a road condition of the potential road section, at 520. The road condition is generated at least based on monitoring records of a second vehicle (for example, the vehicle 410) moving on the potential road section. For example, the monitoring records can include a plurality of positions of the second vehicle during moving, a video captured associated with movement of the second vehicle on the potential road section, a position of the second vehicle on the potential road section when capturing the video, time information of the second vehicle on the potential road section when capturing the monitoring records and the like. The generation of the road condition will be described in detail with reference to FIGS. 8-10.

In some embodiments, the computer system/server 12 can determine whether the potential road section is a closed road section with a single exit, such as the highway with only one exit. When it is determined that the potential road section is a closed road section, the computer system/server 12 can obtain the road condition of the potential road section. This is because when a vehicle moves onto a closed road section with severe congestion, the vehicle can not be able to leave this road section via another exit, and must wait to pass this road section, which usually wastes a large amount time. As shown in FIG. 7, the road section 710 only has a single exit 715.

In obtaining the road condition, the computer system/server 12 can transmit an alert about the potential road section to the first vehicle, at 530. In some embodiments, when the road condition indicates that the potential road section is unsuitable for moving on, the computer system/server 12 can transmit an alert about the potential road section to the first vehicle. As described above, the alert can include, for example, the video captured by the second vehicle regarding the congestion and the accident, the identification of the road section, the direction of the road section, the congestion level of the road section, the offset of the accident, and the like.

As such, the driver of the first vehicle can be notified of the actual condition of the potential road section in an accurate and instinctive manner In this case, the driver can easily avoid being caught in a traffic jam and effectively plan his or her route to the destination. Thus, the time waste can be reduced and the user experience can be enhanced.

Figure 8:
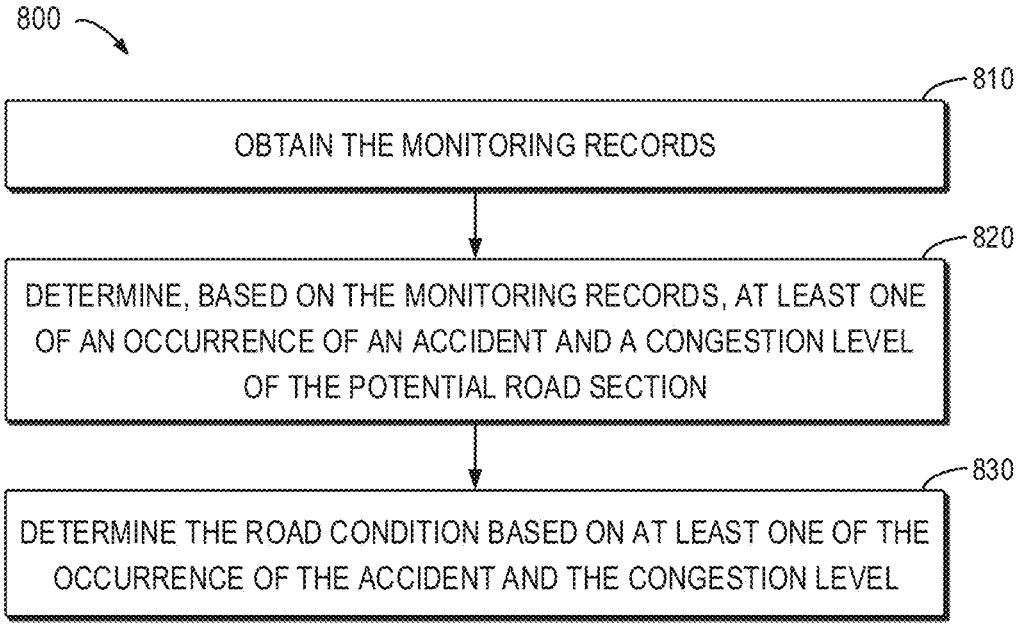
FIG. 8 depicts a flow chart of an example computer-implemented method of determining a road condition according to an embodiment of the present invention.
Figure 9:
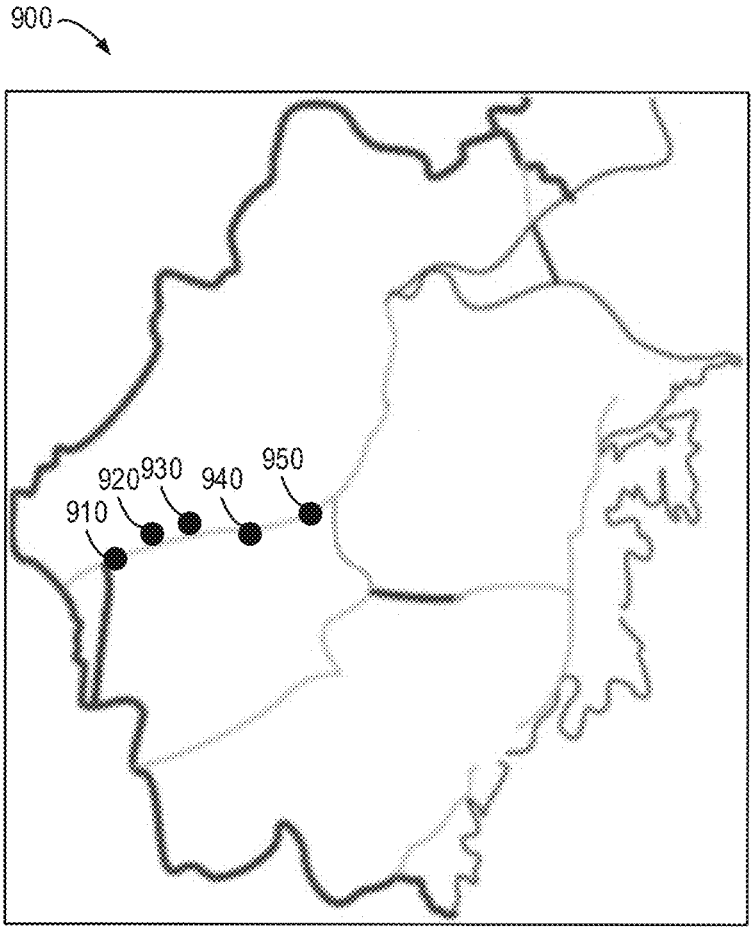
FIG. 9 depicts a schematic diagram of a plurality of positions of a further vehicle during moving according to an embodiment of the present invention.
Figure 10:
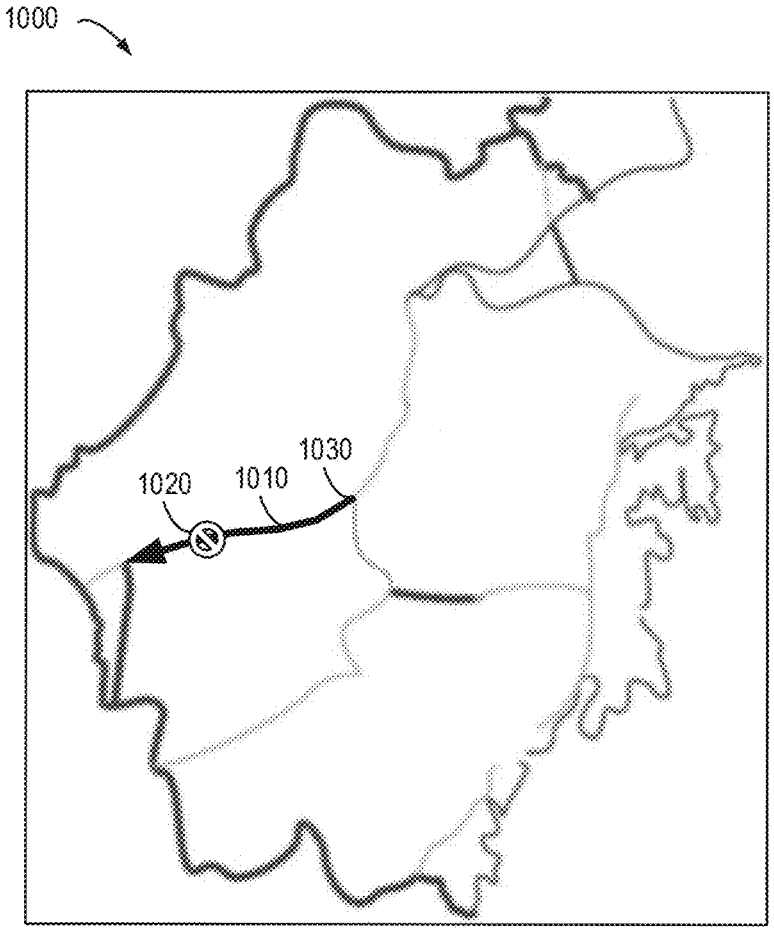
FIG. 10 depicts a schematic diagram of a road section on which the further vehicle is moving according to an embodiment of the present invention.

Then, the generation of the road condition will be described in detail with reference to FIGS. 8-10. FIG. 8 depicts a flow chart of an example computer-implemented method 800 of determining a road condition according to an embodiment of the present invention.

At 810, the computer system/server 12 can obtain the monitoring records. As described above, the monitoring records can include a plurality of positions of the second vehicle (for example, the vehicle 410) during moving, a video captured associated with movement of the second vehicle on the potential road section, a position of the second vehicle on the potential road section when capturing the video, time information of the second vehicle on the potential road section when capturing the monitoring records and the like. The monitoring records can be provided by the second vehicle. In some embodiments, the monitoring records can be stored locally in the computer system/server 12, or remotely in a remote storage which can be, for example, a cloud storage, a distributed storage or the like.

In order to determine the road condition, the computer system/server 12 can first determine the monitored road section (which is determined to be the potential road section of the first vehicle in a later time) on which the second vehicle is moving when collecting the monitoring records. For example, when the monitoring records include a plurality of positions of the second vehicle during moving, the computer system/server 12 can determine the monitored road section of the second vehicle based on the plurality of positions.

For example, the second vehicle can send a plurality of positions of the second vehicle during moving. Specifically, the position can be latitude and longitude of the first vehicle in the Global Position System (GPS). As shown in the schematic diagram 900 of FIG. 9, the second vehicle can send the positions 910-950.

Then, the computer system/server 12 can determine the monitored road section based on the plurality of positions and a map comprising at least the plurality of positions. For example, the computer system/server 12 can determine the monitored road section by map mapping. As a specific example, the computer system/server 12 can map the plurality of positions into one or more candidate road sections, and select a candidate road section to be the monitored road section according to the shortest path algorithm. As shown in the schematic diagram 1000 of FIG. 10, the computer system/server 12 can determine the monitored road section 1010 based on the received positions 910-950 by map mapping. In this case, the road section on which the vehicle is currently moving can be determined accurately.

At 820, the computer system/server 12 can determine, based on the monitoring records, at least one of an occurrence of an accident and a congestion level of the monitored road section 1010. In determining the occurrence of the accident, when the monitoring records includes a video captured associated with movement of the second vehicle on the potential road section, the computer system/server 12 can determine the occurrence of the accident based on the video. For example, the computer system/server 12 can identify the accident by analyzing an image of a video frame, so as to determine whether an accident has occurred on the potential road section, what type of accident has occurred, the severity of the accident, or the like, and thus determining the occurrence of the accident.

Additionally, in some embodiments, the monitoring record can include a position of the second vehicle on the monitored road section 1010 when capturing the video. In this case, when the occurrence of the accident indicates that the accident has occurred, the computer system/server 12 can determine an offset of a position of the accident from a reference position of the potential road section. For example, the occurrence of the accident can indicate that an accident 1020 occurs on the monitored road section 1010. The computer system/server 12 can determine the offset of the accident position from the entrance 1030 of the monitored road section 1010. For example, it can be determined that the offset is 50 meters from the entrance 1030 of the monitored road section 1010. As such, the position of the accident can be accurately determined, so as to provide more reliable and thorough information to the first vehicle.

Alternatively or in addition, in determining the congestion level, when the monitoring records include position information and time information of the second vehicle on the monitored road section 1010 when capturing the monitoring records, the computer system/server 12 can determine, based on the position information and the time information, a speed of the second vehicle when capturing the monitoring records. For example, the computer system/server 12 can obtain a series of GPS positions and the corresponding time when the second vehicle is at a respective GPS position. In this case, the speed between two GPS positions can be calculated based on the distance and time difference of the two GPS positions.

Then, the computer system/server 12 can compare the determined speed to a predetermined threshold, so as to determine a congestion level of the potential road section based on the comparison result. For example, a speed lower than 10 kilometers per hour can be specified as indicating a high level of congestion, a speed lower than 30 kilometers and higher than 10 kilometers per hour can be specified as indicating a moderate level of congestion, and a speed higher than 30 kilometers per hour can be specified as indicating a low level of congestion. As such, the congestion level of the potential road section can be accurately determined, which also helps the driver of the first vehicle to know the actual traffic condition he or she might encounter.

At 830, the computer system/server 12 can determine the road condition of the monitored road section based on at least one of the occurrence of the accident and the congestion level. For example, the computer system/server 12 can determine that the road condition indicates that the potential road section is unsuitable for moving, when an accident has occurred on the potential road section and/or a congestion level of the potential road section exceeds a predetermined threshold (such as a high congestion level).

It should be understood that, the determined road condition can be stored locally in the computer system/server 12, or remotely in a remote storage which can be, for example, a cloud storage, a distributed storage or the like. Alternatively or in addition, the information determined from the monitoring records collected by the second vehicle or the monitoring records per se can also be stored locally in the computer system/server 12, or remotely in a remote storage. The determined information can include at least one of the video captured by the second vehicle regarding the congestion and the accident, the identification of the road section, the direction of the road section, the congestion level of the road section, the offset of the accident, and the like. By this way, the stored information from the second vehicle can be used by the first vehicle in a later time.

The present invention may be a system, a computer-implemented method, and/or a computer program product at any possible technical detail level of integration. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, configuration data for integrated circuitry, or either source code or object code written in any combination of one or more programming languages, including an object oriented programming language such as Smalltalk, C++, or the like, and procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of computer-implemented methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, computer-implemented methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the blocks may occur out of the order noted in the Figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. A computer-implemented method, comprising:

determining, by a device operatively coupled to one or more processing units, a potential road section associated with a current road section on which a first vehicle is moving, the potential road section being a road section to which the first vehicle potentially moves from the current road section;

obtaining, by the device, a road condition associated with an accident on the potential road section, the road condition being generated at least based on monitoring records of a second vehicle moving on the potential road section, wherein the monitoring records are automatically generated by at least one instrument installed on the second vehicle; and in response to the road condition indicating that the potential road section is unsuitable for moving on, transmitting, by the device, an alert about the potential road section to the first vehicle, wherein the alert initiates presentation of a user interface in the first vehicle that enables a driver of the first vehicle to request that the device locate a third vehicle that is currently on the potential road section and obtain other monitoring records of the third vehicle associated with a current road condition of the potential road section.

2. The computer-implemented method of claim 1, wherein determining the potential road section comprises:

determining, by the device, a moving direction of the first vehicle on the current road section;

determining, by the device, a set of candidate road sections being connected to the current road section; and selecting, by the device, a candidate road section in the set of candidate road sections to be the potential road section, a direction of the selected candidate road section matching the moving direction.

3. The computer-implemented method of claim 1, wherein determining the potential road section comprises:

obtaining, by the device, a set of historical movement patterns of the first vehicle, the set of historical movement patterns being generated based on historical movement behaviors of the first vehicle;

selecting, by the device and from the set of historical movement patterns, a historical movement pattern matching the current road section; and determining, by the device, the potential road section based on the selected historical movement pattern and the current road section.

4. The computer-implemented method of claim 1, wherein determining the potential road section comprises:

obtaining, by the device, navigation information of the first vehicle, the navigation information indicating a destination of the first vehicle; and determining, by the device, the potential road section based on the navigation information and the current road section.

5. The computer-implemented method of claim 1, wherein obtaining the road condition comprises:

determining, by the device, whether the potential road section is a closed road section with a single exit; and in response to determining that the potential road section is a closed road section, obtaining, by the device, the road condition.

6. The computer-implemented method of claim 1, further comprising:

obtaining, by the device, a plurality of positions of the first vehicle during moving; and determining, by the device, the current road section based on the plurality of positions and a map comprising at least the plurality of positions.

7. The computer-implemented method of claim 1, wherein obtaining the road condition comprises:

obtaining, by the device, the monitoring records;

determining, by the device and based on the monitoring records, at least one of an occurrence of the accident and a congestion level of the potential road section; and determining, by the device, the road condition based on at least one of the occurrence of the accident and the congestion level.

8. The computer-implemented method of claim 7, wherein the monitoring records at least include a plurality of positions of the second vehicle during moving, and the acts further comprises:

determining, by the device, the potential road section based on the plurality of positions and a map comprising at least the plurality of positions.

9. The computer-implemented method of claim 7, wherein the monitoring records at least include a video captured associated with movement of the second vehicle on the potential road section, and determining the occurrence of the accident comprises:

determining, by the device and based on the video, the occurrence of the accident.

10. The computer-implemented method of claim 9, wherein the monitoring record at least include a position of the second vehicle on the potential road section upon capturing the video, and determining the occurrence of the accident further comprises:

in response to the occurrence of the accident indicating that the accident has occurred, determining, by the device, an offset of a position of the accident from a reference position of the potential road section.

11. The computer-implemented method of claim 7, wherein the monitoring records at least include position information and time information of the second vehicle on the potential road section when capturing the monitoring records, and determining the congestion level comprises:

determining, by the device and based on the position information and the time information, a speed of the second vehicle when capturing the monitoring records; and determining, by the device, a congestion level of the potential road section based on the speed.

12. The computer-implemented method of claim 1, wherein transmitting the alert comprises:

determining that the road condition indicating that the potential road section is unsuitable for moving on based on at least one of an accident has occurred on the potential road section or a congestion level of the potential road section exceeds a predetermined threshold; and in response to the road condition indicating that the potential road section is unsuitable for moving on, transmitting the alert.

13. The computer-implemented method of claim 1, wherein the road condition is generated at least based on monitoring records of a plurality of second vehicle moving on the potential road section.

14. A device, comprising:

a memory that stores computer executable components; and a processing unit operably coupled to the memory, and that executes the computer executable components stored in the memory, wherein the computer executable components comprise:

at least one computer-executable component that:

determines a potential road section associated with a current road section on which a first vehicle is moving, the potential road section being a road section to which the first vehicle potentially moves from the current road section;

obtains a road condition associated with an accident on the potential road section, the road condition being generated at least based on monitoring records of a second vehicle moving on the potential road section, wherein the monitoring records are automatically generated by at least one instrument installed on the second vehicle; and in response to the road condition indicating that the potential road section is unsuitable for moving on, transmits an alert about the potential road section to the first vehicle, wherein the alert initiates presentation of a user interface in the first vehicle that enables a driver of the first vehicle to request that the device locate a third vehicle that is currently on the potential road section and obtain other monitoring records of the third vehicle associated with a current road condition of the potential road section.

15. The device of claim 14, wherein determining the potential road section comprises:

determining a moving direction of the first vehicle on the current road section;

determining a set of candidate road sections being connected to the current road section; and selecting a candidate road section in the set of candidate road sections to be the potential road section, a direction of the selected candidate road section matching the moving direction.

16. The device of claim 14, wherein obtaining the road condition comprises:

obtaining, by the processing unit, the monitoring records;

determining, by the processing unit and based on the monitoring records, at least one of an occurrence of the accident or a congestion level of the potential road section; and determining, by the processing unit, the road condition based on at least one of the occurrence of the accident or the congestion level.

17. The device of claim 16, wherein the monitoring records at least include a plurality of positions of the second vehicle during moving, and the at least one computer-executable component also:

determines, by the processing unit, the potential road section based on the plurality of positions and a map comprising at least the plurality of positions.

18. The device of claim 16, wherein the monitoring records at least include a video captured and associated with movement of the second vehicle on the potential road section, and determining the occurrence of the accident comprises:

determining, by the processing unit and based on the video, the occurrence of the accident.

19. The device of claim 16, wherein the monitoring records at least include position information and time information of the second vehicle on the potential road section upon capturing the monitoring records, and determining the congestion level comprises:

determining, by the processing unit and based on the position information and the time information, a speed of the second vehicle when capturing the monitoring records; and determining, by the processing unit, a congestion level of the potential road section based on the speed.

20. A computer program product facilitating displaying messages based on categories related to message importance, the computer program product comprising a nontransitory computer readable medium having program instructions embodied therewith, the program instructions executable by one or more processors to cause the one or more processors to:

determine, by the one or more processors, a potential road section associated with a current road section on which a first vehicle is moving, the potential road section being a road section to which the first vehicle potentially moves from the current road section;

obtain, by the one or more processors, a road condition associated with an accident on the potential road section, the road condition being generated at least based on monitoring records of a second vehicle moving on the potential road section, wherein the monitoring records are automatically generated by at least one instrument installed on the second vehicle; and in response to the road condition indicating that the potential road section is unsuitable for moving on, transmit, by the one or more processors, an alert about the potential road section to the first vehicle, wherein the alert initiates presentation of a user interface in the first vehicle that enables a driver of the first vehicle to request that the device locate a third vehicle that is currently on the potential road section and obtain other monitoring records of the third vehicle associated with a current road condition of the potential road section.

* * * * *